US005859504A

United States Patent [19]

Nerone

[11] Patent Number: 5,859,504

[45] Date of Patent: Jan. 12, 1999

[54] LAMP BALLAST CIRCUIT WITH CATHODE PREHEAT FUNCTION

[75] Inventor: Louis R. Nerone, Brecksville, Ohio

[73] Assignee: General Electric Company, Schenectady, N.Y.

[21] Appl. No.: 724,629

[22] Filed: Oct. 1, 1996

[51] Int. Cl.[6] ..... H05B 41/00; H05B 41/36

[52] U.S. Cl. ..... 315/307; 315/94; 315/DIG. 5; 315/105; 315/106

[58] Field of Search ..... 315/160, 94, 102, 315/291, 307, DIG. 5, 105, 106, 107, 209 R

[56] References Cited

U.S. PATENT DOCUMENTS

| | | | |
|---|---|---|---|
| 4,251,752 | 2/1981 | Stolz | 315/206 |
| 4,383,203 | 5/1983 | Stanley | 315/248 |
| 4,443,778 | 4/1984 | Mewissen | 336/90 |
| 4,503,360 | 3/1985 | Bedel | 315/112 |
| 4,523,131 | 6/1985 | Zansky | 315/307 |
| 4,546,290 | 10/1985 | Kerekes | 315/209 R |
| 4,570,105 | 2/1986 | Engel | 315/58 |
| 4,988,920 | 1/1991 | Hoeksma | 315/101 |
| 5,075,599 | 12/1991 | Overgoor et al. | 315/224 |
| 5,341,068 | 8/1994 | Nerone | 315/219 |
| 5,363,020 | 11/1994 | Chen et al. | 315/209 R |
| 5,414,325 | 5/1995 | Allison | 315/158 |
| 5,546,300 | 8/1996 | Lee et al. | 363/132 |
| 5,550,436 | 8/1996 | Houk | 315/209 R |

OTHER PUBLICATIONS (Product Note), "Ballast IC Applications Information," International Rectifier Corporation, Oct. 1994, 3 pages.

(Product Note), "Compact Fluorescent Lamp," SGS–Thompson Microelectronics, Oct. 1995, 2 pages.

*Primary Examiner*—Robert Pascal
*Assistant Examiner*—Arnold Kinkead
*Attorney, Agent, or Firm*—George E. Hawranko

[57] ABSTRACT

A ballast circuit for a gas discharge lamp contained within a resonant load circuit has resistively heated cathodes. A d.c.-to-a.c. converter circuit supplyies a.c. current to the resonant load circuit. The converter circuit comprises first and second switches serially connected between a bus conductor at a d.c. voltage and a reference conductor, and has a common node through which the a.c. current flows. In an arrangement for controlling the converter switches, a comparator circuit compares a signal on a first input node with a periodic reference signal on a second input node, and produces a comparator output signal that changes state when a first one of the compared signals becomes greater than the second of the compared signals, and that further changes state when the second of the compared signals then becomes greater than the first of the compared signals. A circuit generates the periodic reference signal in response to the comparator output signal. A first circuit produces a signal on the first input node upon initial converter energization, for preventing lamp ignition while the lamp cathodes become heated. A second circuit for producing a signal on the first input node for allowing lamp ignition comprises a feedback circuit for sensing a.c. current in the resonant load circuit and producing a feedback signal in proportion to the a.c. current. The feedback signal is coupled to the first input node after a predetermined period of time from initial energizing of the converter circuit, during which period the lamp cathodes become heated.

10 Claims, 4 Drawing Sheets

Fig. 4
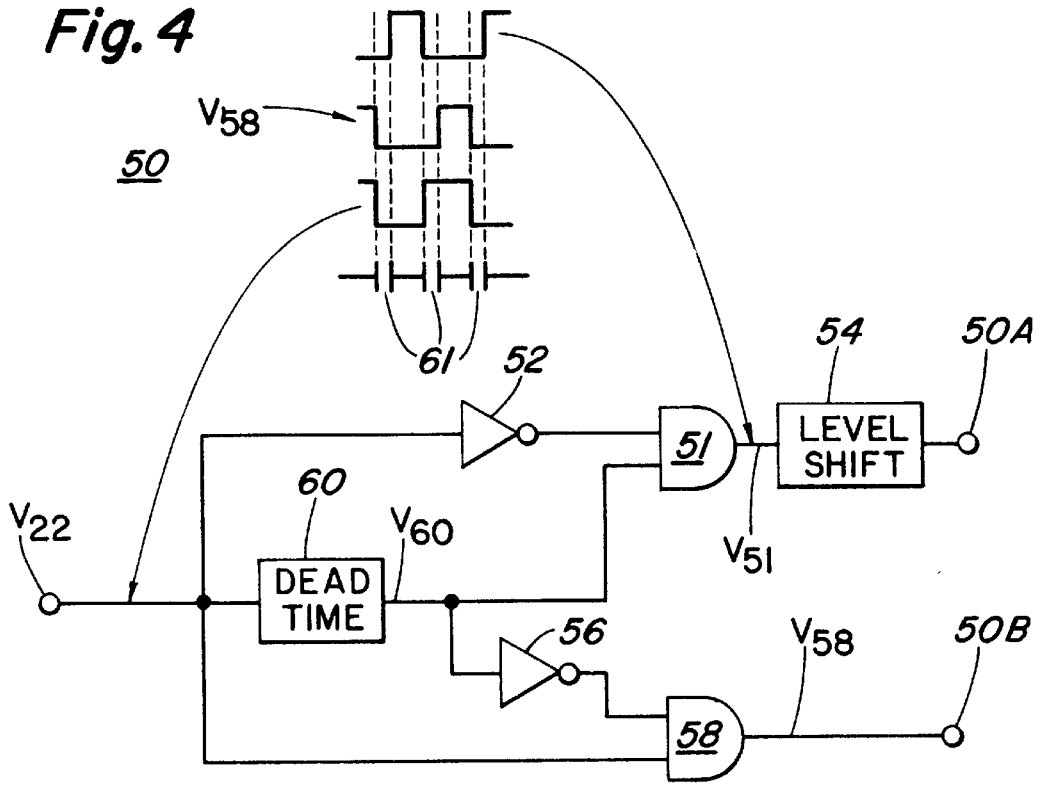
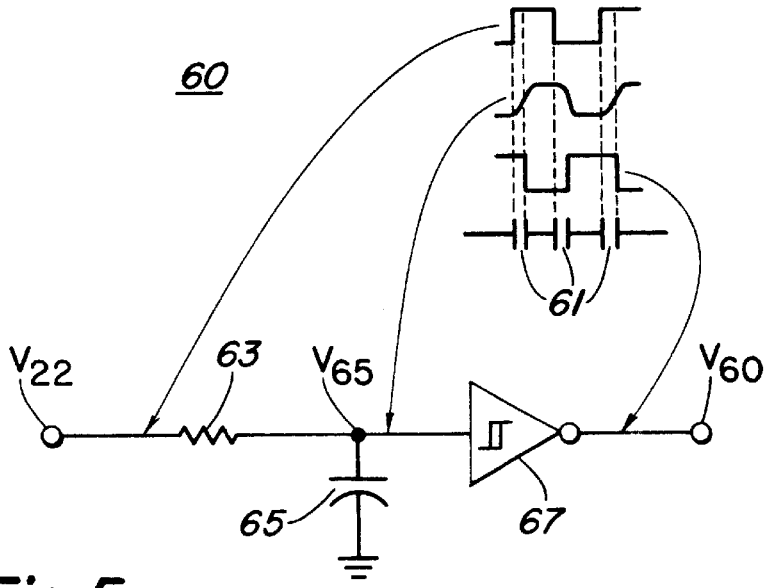
Fig. 5

LAMP BALLAST CIRCUIT WITH CATHODE PREHEAT FUNCTION

CROSS-REFERENCE TO RELATED APPLICATION

This application is related to application Ser. No. 08/644,466 now U.S. Pat. No. 5,703,439, filed on May 10, 1996, entitled "Lamp Power Supply Circuit with Electronic Feedback Circuit for Switch Control," by Louis R. Nerone, the present inventor. It is also related to application Ser. No. 08/644,318 now U.S. Pat. No. 5,717,295, filed on May 10, 1996, entitled "Lamp Power Supply Circuit with Feedback Circuit for Dynamically Adjusting Lamp Current," by Louis R. Nerone, the present inventor. The foregoing applications are commonly owned with the instant application, and their entire disclosures are incorporated herein.

FIELD OF THE INVENTION

The present invention relates to a ballast, or power supply, circuit for a gas discharge lamp. More particularly, it relates to such a ballast circuit employing plural power switches that are controlled in a regenerative manner, and including a cathode preheat function.

BACKGROUND OF THE INVENTION

A gas discharge lamp, such as a fluorescent lamp, typically utilizes a ballast circuit to convert an a.c. line voltage to a high frequency a.c. voltage which is impressed across a resonant load circuit containing the gas discharge lamp. The resonant load circuit includes a resonant inductor and a resonant capacitor for determining the frequency of resonance of current in the resonant load circuit. The ballast circuit typically includes a series half-bridge d.c.-to-a.c. converter having a pair of power switches that alternately connect one end of the resonant load circuit to a d.c. bus voltage and then to a ground, thereby impressing the mentioned a.c. voltage across the resonant load circuit. Typically, gate-drive circuitry is provided to control the switches of the converter in a regenerative, or self-resonant, manner.

The above cross-referenced patent applications relate to the implementation of regenerative gate-drive circuitry, which beneficially can be implemented in state form. As such, the circuitry does not require the use of a magnetic transformer, as do many prior art circuits, and many of its components can be implemented in an integrated circuit. However, it would be desirable to improve upon the gate-drive circuitry of the above crossreferenced applications, and to include a cathode preheat function, whereby the cathodes of the lamp are heated for a predetermined period of time prior to ignition of the lamp. During the cathode preheat period, it would be desirable to maintain a low lamp voltage to prevent ignition of the lamp before the cathodes are sufficiently heated.

OBJECTS AND SUMMARY OF THE INVENTION

It is, therefore, an object of the present invention to provide a ballast circuit for a gas discharge lamp that includes, for controlling a pair of power switches, a regenerative feedback circuit not requiring a magnetic transformer, and which includes a cathode preheat function.

A further object of the invention is to provide a gas discharge lamp ballast circuit of the foregoing type in which the lamp voltage is maintained sufficiently low during the cathode preheat period to prevent ignition of the lamp before the cathodes are suitably heated.

In accordance with one form of the invention, a ballast circuit for a gas discharge lamp contained within a resonant load circuit has resistively heated cathodes. A d.c.-to-a.c. converter circuit supplies a.c. current to the resonant load circuit. The converter circuit comprises first and second switches serially connected between a bus conductor at a d.c. voltage and a reference conductor, and has a common node through which the a.c. current flows. In an arrangement for controlling the converter switches, a comparator circuit compares a signal on a first input node with a periodic reference signal on a second input node, and produces a comparator output signal that changes state when a first one of the compared signals becomes greater than the second of the compared signals, and that further changes state when the second of the compared signals then becomes greater than the first of the compared signals. A circuit generates the periodic reference signal in response to the comparator output signal. A first circuit produces a signal on the first input node upon initial converter energization, for preventing lamp ignition while the lamp cathodes become heated. A second circuit for producing a signal on the first input node for allowing lamp ignition comprises a feedback circuit for sensing a.c. current in the resonant load circuit and producing a feedback signal in proportion to the a.c. current. The feedback signal is coupled to the first input node after a predetermined period of time from initial energizing of the converter circuit, during which period the lamp cathodes become heated.

BRIEF DESCRIPTION OF THE DRAWINGS

In the following detailed description, reference will be made to the attached drawings in which like reference numerals refer to like, or corresponding elements, throughout the following figures:

FIG. 4 is a schematic representation of an exemplary implementation of phase splitter, dead time & level shift circuit 50 of FIG. 3.

FIG. 5 is a shematic representation of an exemplary implementation of dead time circuit 60 of FIG. 4.

DETAILED DESCRIPTION OF THE PREFERRED EMBODIMENTS

Figure 1:
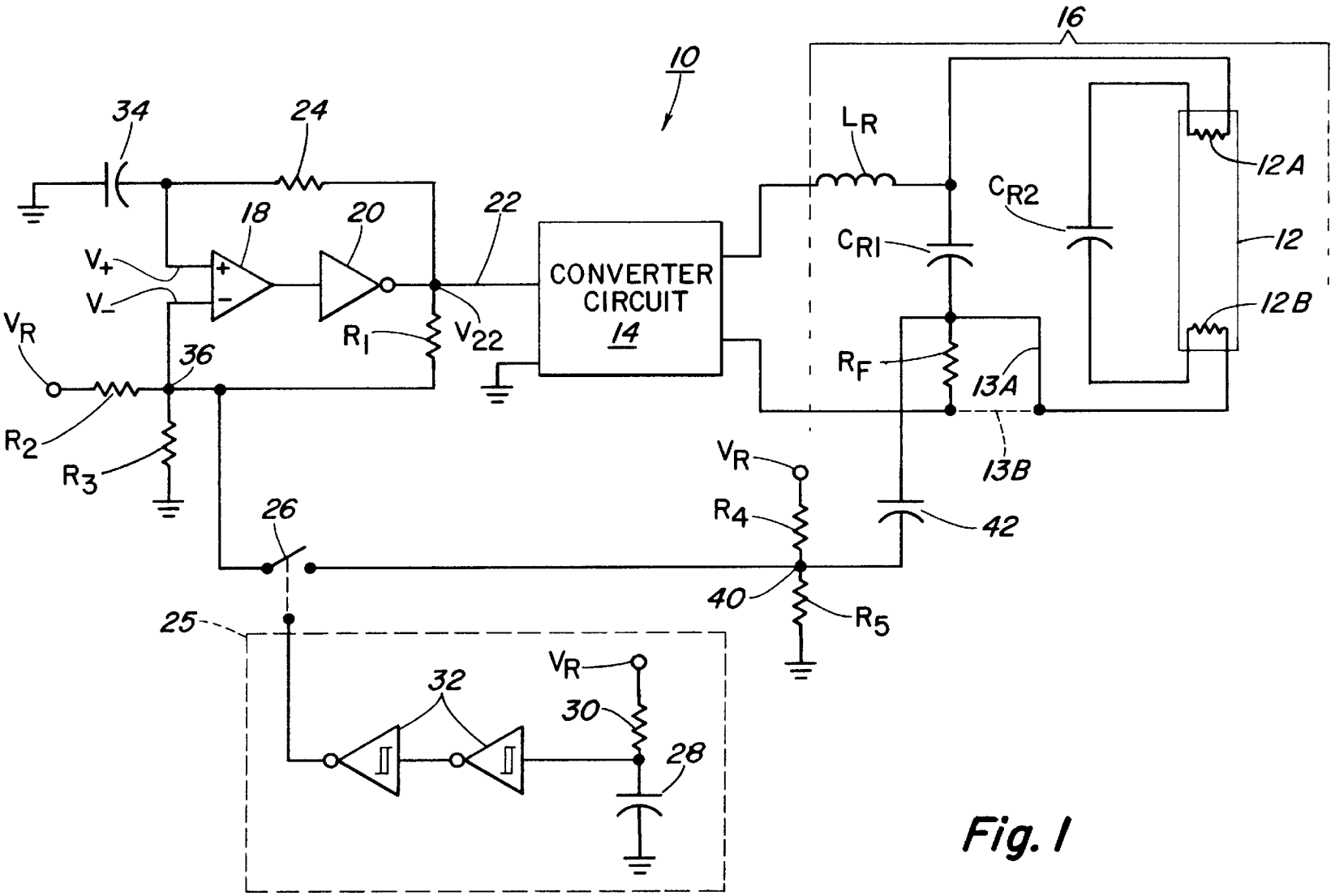
FIG. 1 is a schematic diagram, partially in block form, of a ballast circuit for a gas discharge lamp, which exclusively uses electronic components in a feedback circuit for implementing regenerative control of a pair of power switches, and which provides a cathode pre-heat function.

Referring to FIG. 1, an electronic ballast arrangement for a gas discharge lamp 12, such as a compact fluorescent lamp, is shown. Lamp 12 includes resistively heated cathodes 12A and 12B. A converter circuit 14 provides a.c. current to a resonant load circuit 16, which includes lamp 12, a resonant inductor $L_R$, a resonant capacitor $C_{R1}$, and, preferably, another capacitor $C_{R2}$ shunted across lamp 12, and whose capacitance augments that of resonant capacitor $C_{R1}$. A current-sensing feedback resistor $R_F$ is connected to cathode 12B by either conductor 13A, shown in solid lines, or conductor 13B, shown in dashed lines, the choice of position typically being determined by the level of voltage present in resonant load circuit 16. Details of converter circuit 16 are set forth below.

A comparator 18 provides a control signal for converter circuit 14, which is first passed through an inverting buffer 20, and is then provided as voltage signal $V_{22}$ on line 22. Comparator 18 has an inverting input marked "–" on which input voltage signal $V_-$ exists, and a non-inverting input marked "+" on which input voltage signal $V_+$ exists. Resistors 24 and $R_1$, described below, provide feedback paths from output signal $V_{22}$ to input signals $V_+$ and $V_-$, respectively. In order to assure stable operation of comparator 18, non-inverting buffer 20 provides a propagation delay from the comparator to output signal $V_{22}$. Accordingly, signal $V_{22}$ changes state only after input voltages $V_+$ and $V_-$ are stabilized.

A timer circuit 25 causes a switch 26 to remain open, or nonconducting, upon energization of converter circuit 14, typically for about one second. A reference voltage $V_R$ is provided upon energization of converter circuit 14, and charges capacitor 28 through a resistor 30. The voltage on capacitor 28 drives a serially connected pair of inverting buffers 32 of the type having hysteresis, as noted by the hysteresis symbols on the triangular symbols for the buffers. These buffers thus provide a distinct rise in voltage after a predetermined period of time of typically one second, so as to cause switch 26 to close. Switch 26 is preferably an analog switch, such as an n-channel, enhancement mode MOSFET.

CATHODE PRE-HEAT OPERATION

Figure 2:
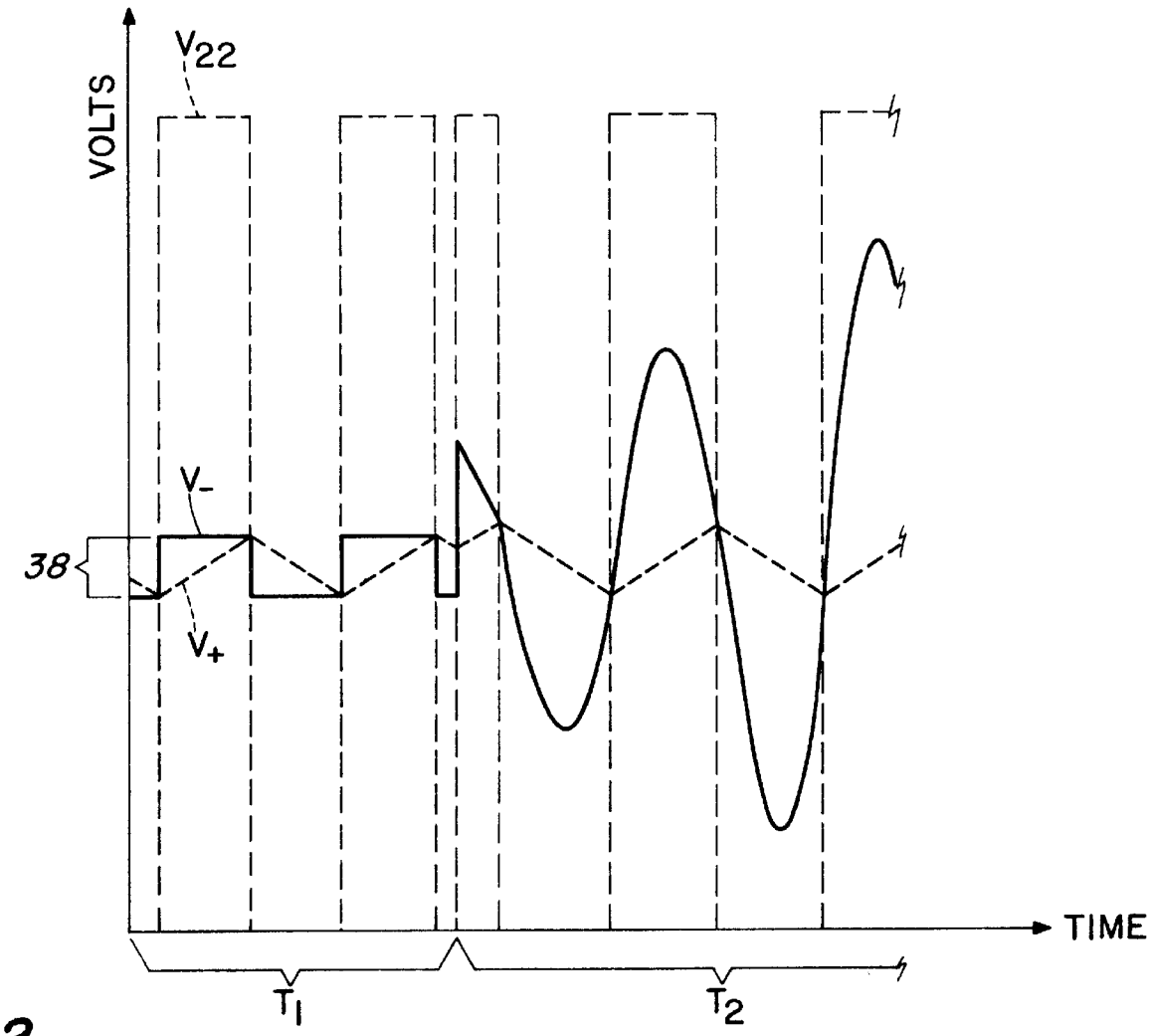
FIG. 2 shows simplified voltage waveforms for voltage signals $V_{22}$, $V_-$ and $V_+$ of FIG. 1.

Operation of comparator 18 during the period in which switch 26 remains open after energization of converter circuit 14 is now described. Reference should be made to FIG. 2, in addition to FIG. 1, which shows simplified voltage waveforms for output voltage signal $V_{22}$, and input voltage signals $V_-$ and $V_+$. As shown in FIG. 2, time period $T_1$ is the period in which switch 26 remains open after converter circuit 14 is energized. During this time, cathodes 12A and 12B are allowed to become heated by current in resonant load circuit 16. The frequency of such current during time period $T_1$ is set at a suitable level, for instance, to prevent premature ignition of lamp 12. The circuity connected to comparator 18 determines the frequency of current in load circuit 16. More specifically, the frequency of load current is typically selected to be 20 to 50 percent higher than the natural resonant frequency of load circuit 16 during the cathode preheat period. This keeps the lamp voltage low, to prevent premature lamp ignition, while maintaining adequate current through the lamp cathodes to allow them to become suitably heated prior to lamp ignition.

As can be seen from FIG. 2, output signal $V_{22}$ changes in a square-wave manner between a high value and zero. As can be seen in the figure, the points of switching of signal $V_{22}$ from a low state to a high state occur when signal $V_-$ exceeds signal $V_+$. The points of switching of signal $V_{22}$ from a high state to a low state occur when signal $V_+$ exceeds signal $V_-$. The approximately triangular signal $V_+$ is generated from the high or low signal $V_{22}$ respectively charging or discharging capacitor 34 through resistor 24. It is preferred that the upward and downward slopes of voltage signal $V_+$ be fairly linear, so that a distinct change in output of comparator 18 occurs when signal $V_+$ surpasses the value of signal $V_-$. For instance, the linear portions of signal $V_+$ are preferably from the first quarter of the time constant for charging and discharging capacitor 34 (FIG. 1). In FIG. 2, it can be seen that signal $V_+$, shown as approximately triangular, has a predominantly higher-going portion and a predominantly lower-going portion.

Meanwhile, during the time switch 26 is open, approximately square wave signal $V_-$ is generated by the operation of a resistive voltage-divider network of resistors $R_2$ and $R_3$, driven by reference voltage $V_R$. Such reference voltage is preferably the same voltage that charges capacitor 28 of timer circuit 24. Specifically, the resistive voltage-divider network provides a d.c. component of voltage on node 36. An additional component of voltage of node 36 is provided by the action of resistor $R_1$ having one end connected to node 36 and its other end connected to node 22 to receive signal $V_{22}$. The resulting voltage signal on node 36, i.e., voltage $V_-$, is shown in FIG. 2 as being a square wave during time period $T_1$ . The vertical excursion 38 of such square wave signal determines when signal $V_{22}$ changes from one state to the other, and ultimately determines the frequency of current in resonant load circuit 16. Vertical excursion 38, in turn, is determined by the value of resistor $R_1$.

SYNCHRONIZED OPERATION

When switch 26 becomes closed, due to the above-described operation of timer circuit 25, feedback voltage $V_F$ becomes the dominant voltage on node 36, and hence effectively determines comparator input signal $V_-$. This is because the value of feedback resistor $R_F$ is much lower than the values of resistors $R_1$, $R_2$ and $R_3$, and also of resistors $R_4$ and $R_5$. The latter two resistors, i.e., $R_4$ and $R_5$, across which reference voltage $V_R$ is impressed, provide a d.c. level for the voltage at their commonly connected node 40. Such d.c. level is preferably the same as the d.c. level provided on node 36 by resistors $R_2$ and $R_3$, with the result that the voltage across switch 26 is approximately zero before the switch is closed. Capacitor 42 is used to obtain proper coupling between the voltage produced across feedback resistor $R_F$, and the d.c. level provided by network $R_4$ and $R_5$.

With feedback voltage $V_F$ effectively determining comparator input voltage $V_-$ during time period $T_2$, the transition points of when output voltage $V_{22}$ transitions to a high value or to a low value are no longer determined by the square wave shown for time period $T_1$. Rather, the approximately sinusoidal waveform $V_-$ interacts with triangular waveform $V_+$, resulting in a frequency that tends to become synchronized with the natural resonant frequency of resonant load circuit 16. During time period $T_2$, therefore, lamp ignition is allowed to take place with resonant load circuit 16 naturally approaching its resonant frequency. After ignition, the resistance of lamp 12 decreases considerably, with the frequency of operation of resonant load circuit 16 thereby changing to a steady state value differing from that at lamp ignition.

Figure 3:
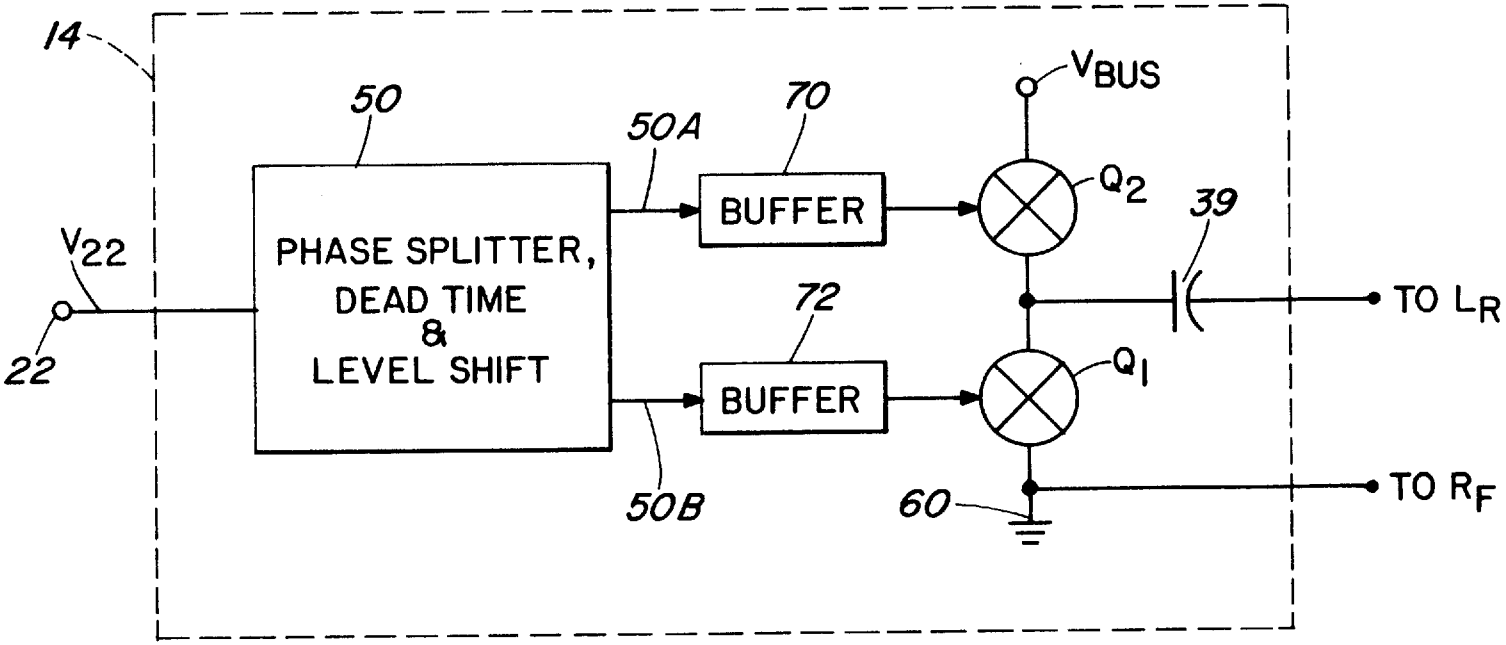
FIG. 3 is a schematic diagram, partially in block form, of a preferred implementation of converter circuit 14 of FIG. 1.

FIG. 3 shows a preferred implementation for converter circuit 14, which is shown in block form in FIG. 1. Output voltage $V_{22}$ on line 22 (FIG. 1) is received by phase splitter, dead time & level shift circuit 50, described below in connection with FIG. 4. Circuit 50 provides appropriate signals on lines 50A and 50B that are respectively received by conventional buffers 70 and 72. These buffers are used to drive the gates of MOSFET switches $Q_1$ and $Q_2$ with a low impedance. The common connection between switches $Q_1$ and $Q_2$ is connected to resonant inductor $L_R$, through a d.c. blocking capacitor 39; and the lower node of switch $Q_1$, shown at a reference node 60 (e.g., a ground), is connected to feedback resistor $R_F$.

FIG. 4 shows an exemplary implementation of phase splitter, dead time & level shift circuit 50 of FIG. 3. As FIG. 4 shows, output signal $V_{22}$ is applied to a dead time circuit 60, one implementation of which is shown in FIG. 5. In FIG. 5, a circuit comprising resistor 63 and capacitor 65 receives output signal $V_{22}$, and provides a delayed input, shown as voltage $V_{65}$, to a logic NOT gate 67. Gate 67 is of the type having hysteresis, as indicated by the hysteresis notation in the symbol for gate 67, whereby its input threshold voltage is a function of the state of its output voltage. Gate 67 produces an output voltage $V_{60}$, which transitions in the opposite manner from output signal $V_{22}$, but only after respective delay (or dead-time) intervals 61. A typical delay interval 61 for a lamp operating at a frequency of 65 kilo-hertz is one microsecond.

Referring back to FIG. 4, dead-time circuit output voltage $V_{60}$ is then input into a logic AND gate 51. The other input to gate 51 is the output of logic NOT gate 52, which inverts output signal $V_{22}$. The output of AND gate 51, voltage $V_{51}$, is shown in FIG. 4. Output voltage $V_{51}$, is level-shifted by a conventional level shift circuit 54, to provide an appropriate signal on conductor 50A to drive the gate of upper MOSFET $Q_1$ in FIG. 3 after passing through buffer 70 (FIG. 3).

For driving the gate of the lower MOSFET $Q_2$ in FIG. 3, a gate-driving voltage $V_{58}$ is produced by the circuit of FIG. 4. To accomplish this, a logic NOT gate 56 first inverts dead-time circuit output $V_{60}$ and applies the resulting voltage as one input to logic AND gate 58. The other input to AND gate 58 is output signal $V_{22}$. Due to the inclusion of NOT gate 56, the gate-driving output voltage $V_{58}$ of AND gate 58 appears as shown in the figure, with its phase shifted 180° from the phase of gate-drive signal $V_{51}$. This realizes the phase-splitting function of circuit 50.

As further shown in FIG. 4, the high states of gate-drive signal $V_{58}$ are separated from the high states of gate-drive signal $V_{51}$, on both leading and trailing sides, by dead-time intervals 61. This assures high speed operation of MOSFET switches $Q_1$ and $Q_2$, since so-called soft switching techniques (e.g., zero-voltage switching) can be employed.

The various functions of phase splitter, dead time & level shift circuit 50 of FIGS. 3 and 4, as well as the function of buffers 70 and 72 in FIG. 2, can be implemented in an obvious manner by those of ordinary skill in the art. For instance, an IR2155 self-oscillating power MOSFET/IGBT gate driver from International Rectifier Company of El Segundo, Calif. could be utilized with the connections illustrated for "bootstrap operation" in its Provisional Data Sheet 6.029, dated Jan. 13, 1994. With the foregoing gate driver, the so-called RT input can be left open, and the present output signal $V_{22}$ can be applied to the so-called CT input of the gate driver. However, the ability to set the dead time of present dead-time circuit 60 of FIGS. 4 and 5 is not present with the use of the foregoing gate driver.

Exemplary circuit values for a circuit for a 25-watt fluorescent lamp 12 with an operating current of 65 kilohertz, with a d.c. input voltage of 160 volts, are as follows:

Resonant inductor, $L_R$ . . . 800 micro henries
Resonant capacitor $C_{R1}$ . . . 4.4 nanofarads
Resonant capacitor $C_{R2}$ . . . 3.3 nanofarads
Feedback resistor $R_F$ . . . 1 ohm
Capacitor 42 . . . 3.3 nanofarads
Resistors $R_4$ and $R_5$, each . . . 1 Megohm
Resistor 30 . . . 2.4 Megohms
Capacitor 28 . . . 100 nanofarads
Voltage $V_R$ . . . 5 volts
Resistors $R_2$ and $R_3$, each . . . 10K ohms
Capacitor 34 . . . 3.3 nanofarads
Resistor 24 . . . 10K ohms
Resistor $R_1$ . . . 47K ohms
D.c. blocking capacitor 39 (FIG. 3) . . . 1 microfarad Additionally, invertors 32 can each be the product designated CD40106B and sold by Harris Semiconductor of Melbourne, Fla.; switches $Q_1$ and $Q_2$ can each be n-channel, enhancement mode MOSFETs; and switch 26 can be an n-channel, enhancement mode MOSFET sold under the product designation CD4016B by the mentioned Harris Semiconductor.

The foregoing describes a ballast circuit for a gas discharge lamp that includes, for controlling a pair of power switches, a regenerative feedback circuit not requiring a magnetic transformer, and which includes a cathode preheat function. Beneficially, the lamp voltage is maintained sufficiently low during the cathode preheat period to prevent ignition of the lamp before the cathodes are suitably heated.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit for a gas discharge lamp having resistively heated cathodes, comprising:

(a) a resonant load circuit incorporating a gas discharge lamp and including a resonant inductor and a resonant capacitor;

(b) a d.c.-to-a.c. converter circuit coupled to said resonant load circuit for supplying a.c. current to said resonant load circuit; said converter circuit comprising first and second switches serially connected between a bus conductor at a d.c. voltage and a reference conductor, and having a common node through which said a.c. current flows;

(c) a switch control arrangement for controlling said first and second switches, comprising:

(i) a comparator circuit for comparing a signal on a first input node with a periodic reference signal on a second input node, and for producing a comparator output signal that changes state when a first one of the compared signals becomes greater than the second of the compared signals, and that further changes state when the second of the compared signals then becomes greater than the first of the compared signals; and (ii) a circuit for generating said periodic reference signal in response to said comparator output signal;

(d) a first circuit for producing a signal on said first input node upon energizing of said converter circuit but prior to ignition of the lamp; said signal on said first input node being selected to prevent ignition of the lamp while the lamp cathodes become heated;

(e) a second circuit for producing a signal on said first input node for allowing the lamp to ignite and then to operate; said second circuit comprising:

(i) a feedback circuit for sensing a.c. current in said resonant load circuit and producing a feedback signal in proportion to said a.c. current; and (ii) a circuit for coupling said feedback signal to said first input node after a predetermined period of time from initial energizing of said converter circuit, during which period of time the cathodes of the lamp become heated; and (f) a conditioning circuit receptive of said comparator output signal for controlling said first and second switches.

2. The ballast circuit of claim 1, wherein said conditioning circuit includes a dead time circuit for creating a dead time interval just prior to said first switch being turned on when both said first and second switches are off, and just prior to said second switch being turned on when both said first and second switches are off.

3. The ballast circuit of claim 2, where said dead time circuit includes means for selecting the duration of said dead time intervals from a range of choices.

4. The ballast circuit of claim 1, wherein said circuit for sensing said a.c. current in said resonant load circuit, and producing a feedback signal, comprises a resistance in said resonant load circuit.

5. A ballast circuit for a gas discharge lamp, comprising:

(a) a resonant load circuit incorporating a gas discharge lamp and including a resonant inductor and a resonant capacitor;

(b) a d.c.-to-a.c. converter circuit coupled to said resonant load circuit for supplying a.c. current to said resonant load circuit; said converter circuit comprising first and second switches serially connected between a bus conductor at a d.c. voltage and a reference conductor, and having a common node through which said a.c. current flows;

(c) a switch control arrangement for controlling said first and second switches, comprising:

(i) a comparator circuit for comparing a signal on a first input node with an approximately triangular, periodic reference signal on a second input node, and for producing a comparator output signal that changes state when a first one of the compared signals becomes greater than the second of the compared signals, and that further changes state when the second of the compared signals then becomes greater than the first of the compared signals; and (ii) a circuit for generating said periodic reference signal in response to said comparator output signal;

(d) a first circuit for producing a signal on said first input node upon energizing of said converter circuit but prior to ignition of the lamp; said signal on said first input node being selected to prevent ignition of the lamp while cathodes of the lamp become heated;

(e) a second circuit for producing a signal on said first input node for allowing the lamp to ignite and then to operate; said second circuit comprising:

(i) a feedback circuit for sensing a.c. current in said resonant load circuit and producing a feedback signal in proportion to said a.c. current; and (ii) a circuit for coupling said feedback signal to said first input node after a predetermined period of time from initial energizing of said converter circuit, during which period of time the cathodes of the lamp become heated; and (f) a conditioning circuit receptive of said comparator output signal for controlling said first and second switches.

6. The ballast circuit of claim 5, wherein said circuit for generating said periodic reference signal comprises a delay circuit for delaying transitioning between a predominantly higher-going portion and a predominantly lower-going portion of said periodic reference signal, so as to assure a stable change of output state of the comparator circuit.

7. The ballast circuit of claim 5, wherein said switch control arrangement comprises:

(a) an inverter responsive to said comparator output signal for producing an inverted comparator output signal;

(b) a resistor connected to receive said inverted comparator output signal on one end and connected to said second input node of said comparator on its other end; and (c) a capacitor connected between said second input node and a conductor at a reference potential;

(d) said periodic reference signal being generated by alternate charging and discharging of said capacitor with a resistive-capacitive time constant determined by the values of said last-mentioned resistor and said last-mentioned capacitor.

8. The ballast circuit of claim 5, wherein said conditioning circuit includes a dead time circuit for creating a dead time interval just prior to said first switch being turned on when both said first and second switches are off, and just prior to said second switch being turned on when both said first and second switches are off.

9. The ballast circuit of claim 8, where said dead time circuit includes means for selecting the duration of said dead time intervals from a range of choices.

10. The ballast circuit of claim 1, wherein said circuit for generating said periodic reference signal comprises a delay circuit for delaying transitioning between a predominantly higher-going portion and a predominantly lower-going portion of said periodic reference signal, so as to assure a stable change of output state of the comparator circuit.

* * * * *